US006168062B1

(12) United States Patent
Varner et al.

(10) Patent No.: US 6,168,062 B1
(45) Date of Patent: Jan. 2, 2001

(54) SELF-ACTUATING SLACK PULLER

(75) Inventors: William L. Varner, Enderby; L. Daan Hengeveld, Surrey, both of (CA)

(73) Assignee: Enderby Manufacturing Corp., Enderby (CA)

( * ) Notice: Under 35 U.S.C. 154(b), the term of this patent shall be extended for 0 days.

(21) Appl. No.: 09/169,553

(22) Filed: Oct. 9, 1998

(51) Int. Cl.[7] ..... B66C 21/00

(52) U.S. Cl. ..... 226/176; 226/187; 226/188; 212/89; 254/287; 254/291; 254/333

(58) Field of Search ..... 226/35, 176, 183, 226/187, 190, 188; 254/264, 287, 291, 333, 361; 212/89, 92, 98, 111, 114, 120

(56) References Cited

U.S. PATENT DOCUMENTS

| | | | | |
|---|---|---|---|---|
| 2,947,516 | * | 8/1960 | Jackson | 226/187 |
| 3,371,770 | * | 3/1968 | Graham et al. | 226/176 |
| 3,392,896 | * | 7/1968 | Ullman | 226/187 |
| 3,466,013 | * | 9/1969 | Smith, Jr. | 254/287 |
| 3,531,000 | | 9/1970 | Rennie et al. . | |
| 3,833,162 | * | 9/1974 | Sato | 226/187 |
| 4,058,295 | | 11/1977 | Morfitt . | |
| 4,127,197 | | 11/1978 | Dumont . | |
| 4,239,038 | * | 12/1980 | Fikoe et al. | 212/89 |
| 4,453,642 | | 6/1984 | Myhre . | |
| 4,454,951 | | 6/1984 | Kuehn . | |
| 4,515,281 | | 5/1985 | Maki . | |
| 4,687,109 | | 8/1987 | Davis . | |
| 5,097,972 | | 3/1992 | Gladhart . | |

* cited by examiner

*Primary Examiner*—Katherine A. Matecki
(74) *Attorney, Agent, or Firm*—Klarquist Sparkman Campbell Leigh & Whinston, LLP

(57) ABSTRACT

A slack puller has symmetrical sheave assemblies on each side of a cable path. The sheave assemblies each include a driven sheave mounted on an arm. When the sheaves are engaged with the cable by an actuator, tension in the cable pulls the sheaves in a way which tends to increase the compressional forces exerted by the sheaves on the cable. The self actuating nature of the slack puller allows compressional forces on the cable to be kept small until the cable comes under tension. The sheaves are driven by positive displacement hydraulic motors connected in series with a hydraulic pump. This permits the sheaves to turn quickly when the cable is not under tension and slows the sheaves as tension in the cable increases. The slack puller operates more quickly and causes less cable damage than conventional slack pullers. The slack puller has particular application in skyline logging operations where its compact size is an additional advantage.

20 Claims, 6 Drawing Sheets

SELF-ACTUATING SLACK PULLER

FIELD OF THE INVENTION

This invention relates to a slack puller for taking up the slack in a cable. The slack puller includes one or more rotating sheaves which may be brought into contact with the cable. The invention has particular application as a slack puller in a log skidding carriage for paying out and taking up slack in a mainline. In a preferred embodiment the puller is hydraulically operated.

BACKGROUND OF THE INVENTION

In typical skyline logging operations a skyline cable is strung over a logging area between a spar on a yarder and a support, such as a spar tree. A carriage is movable along the skyline. A mainline (or "skidder" cable or "drag" cable) extends from a winch on the yarder and over a sheave on the carriage. The main cable terminates at a choker or a number of chokers. The carriage has a skyline brake for arresting the motion of the carriage along the skyline and a mainline brake for arresting the motion of the mainline through the carriage. In operation, the carriage is moved to a location over a log and a chokerman connects the choker to the log. The winch is then operated to lift the log off of the ground and to draw the carriage and log together toward a landing near the yarder.

The main cable is heavy. A slack puller is generally provided in the carriage to draw the mainline through the carriage so that the chokerman can reach the choker and connect the choker to the log. Without a slack puller the end of the mainline would generally be pulled up to the carriage by the weight of the portion of the mainline between the carriage and the yarder which inevitably sags toward the ground. The chokerman would then have to manually pull enough of the mainline over the sheave on the carriage to permit the choker to be connected to the log. The weight of the portion of the mainline between the yarder and the carriage increases as the carriage moves away from the yarder. Pulling the mainline manually would be very arduous for the chokerman, especially if the skyline is high above the ground and the log is in an area of rugged terrain.

Existing slack pullers have two main problems. They are either undesirably slow or they cause excessive damage to the mainline when they are used. Some existing slack pullers are both slow and cause excessive cable damage. Kuehn, U.S. Pat. No. 4,454,951 discloses a log skidding carriage in which the drag line passes between a rotating sheave and a clutch sheave. The clutch sheave can be driven toward the rotating sheave by a hydraulic cylinder. When the hydraulic cylinder is actuated the drag line is pinched between the rotating sheave and the clutch sheave. Kuehn does not provide any means for modulating the force exerted by the hydraulic cylinder. The hydraulic cylinder could exert enough force to damage the drag line, especially if the rotating sheave slips or "chatters" on the drag line when all of the slack has been taken up from the drag line.

Maki, U.S. Pat. No. 4,515,281 shows a log skidding carriage which includes a slack puller comprising a pair of sheaves biased toward each other by a spring. The mainline passes between the sheaves. A hydraulically operated clutch permits the sheaves to rotate freely when the mainline is being pulled in.

Rennie et al. U.S. Pat. No. 3,531,000 and Davis, U.S. Pat. No. 4,687,109 each show a logging carriage in which a load line passes between a rotating sheave and a pair of smaller sheaves. The smaller sheaves are biased against the rotating sheave by a spring mechanism. There is no provision for releasing the spring during operation in either direction.

There is a need for a slack puller which operates more quickly than prior art slack pullers, has better pulling power than existing slack pullers and yet does not cause unnecessary cable damage. More particularly, what is needed is a slack puller that does not apply unnecessarily large compressive forces to a line being pulled and avoids slip or chatter when the line is under tension. There is a particular need for such a slack puller which is compact enough to use in a logging carriage.

SUMMARY OF THE INVENTION

This invention provides a slack puller which may be used to advantage in a logging carriage for taking up slack in a line. The slack puller may also be used to take up slack in lines in other contexts. The slack puller comprises: a first sheave having an axis of rotation, the first sheave coupled to a frame by a first sheave linkage such that the axis of rotation of the first sheave is constrained to travel in a first arcuate path between first and second positions; a second sheave coupled to the frame and rotatable about an axis of rotation; an actuator coupled between the frame and the first sheave to move the first sheave between its first and second positions; and, a motor for turning the first sheave about the first sheave axis of rotation. When the first sheave is in its first position, a line extending between the first and second sheaves is compressed between the first and second sheaves; when the first sheave is in its first position and the motor is operated to turn the first sheave, the line is pulled between the first and second sheaves and tension in the line tends to pull the first sheave along the arcuate path in a direction which moves the first sheave axis of rotation closer to the second sheave axis of rotation. When the first sheave is in its second position, the line is free to slip longitudinally between the first and second sheaves.

Preferably the second sheave is coupled to the frame by a second sheave linkage such that the second sheave axis of rotation is constrained to travel in a second arcuate path between first and second positions and the slack puller comprises a coupling linkage coupling the first and second sheave linkages. The coupling linkage moves the second sheave from its first position to its second position in response to motion of the first sheave from its first position to its second position. The coupling linkage may comprise first and second sectors bearing intermeshing teeth, the first and second sectors rigidly coupled to the first and second sheave linkages. Preferably the second sheave linkage comprises an arm pivotally mounted to the frame.

Most preferably the first and second sheaves are respectively turned by first and second motors respectively mounted on the first and second arms and the first and second motors are positive displacement hydraulic motors connected in series with a hydraulic pump. In a preferred embodiment the hydraulic pump is of the type where a rate of flow of fluid output by the pump approaches zero as an output pressure approaches a maximum pressure.

Another aspect of the invention provides a slack puller for pulling a cable. The slack puller comprises first and second sheave assemblies mounted to a frame on either side of a cable path. Each of the sheave assemblies comprises an arm pivotally mounted to the frame at a pivot point, a sheave mounted to the arm for rotation about an axis of rotation, and a motor for turning the sheave about its axis of rotation. The sheaves are both located on the same side of a reference line joining the pivot points of the first and second sheave assemblies. The slack puller also comprises a linkage connected between the first and second sheave assemblies, the linkage coupling the arms of the first and second sheave assemblies to move toward one another or apart from one another about the cable path; and an actuator coupled to the first sheave assembly for moving the arms between an engaged configuration in which the sheaves would bear against opposed sides of a cable extending along the cable path and a disengaged position wherein the sheaves would not contact a cable extending along the cable path. When the arms are in the engaged configuration, a line between the axis of rotation and the pivot point defines an angle with the reference line in the range of about 10 degrees to about 40 degrees.

In preferred embodiments of this second aspect of the invention, the sheaves of the first and second sheave assemblies are equal in diameter. Most preferably the motors of the first and second sheave assemblies are each positive displacement hydraulic motors and are connected in series with a hydraulic pump.

Yet another aspect of the invention provides a slack puller comprising: a first sheave rotatably mounted on an arm; means for moving the arm to bring the first sheave into contact with a cable thereby compressing the cable against a second sheave; and, driving means for rotating the first sheave in a first sense. When the first sheave is compressing the cable against the second sheave and is being rotated in the first sense by the driving means, tension in the cable acting on the first sheave pivots the arm and thereby moves the first sheave to a position in which it compresses the cable more tightly against the second sheave.

BRIEF DESCRIPTION OF THE DRAWINGS

In drawings which illustrate non-limiting preferred embodiments of the invention.

DETAILED DESCRIPTION OF PREFERRED EMBODIMENTS OF THE INVENTION

Prior Art

Figure 1A:
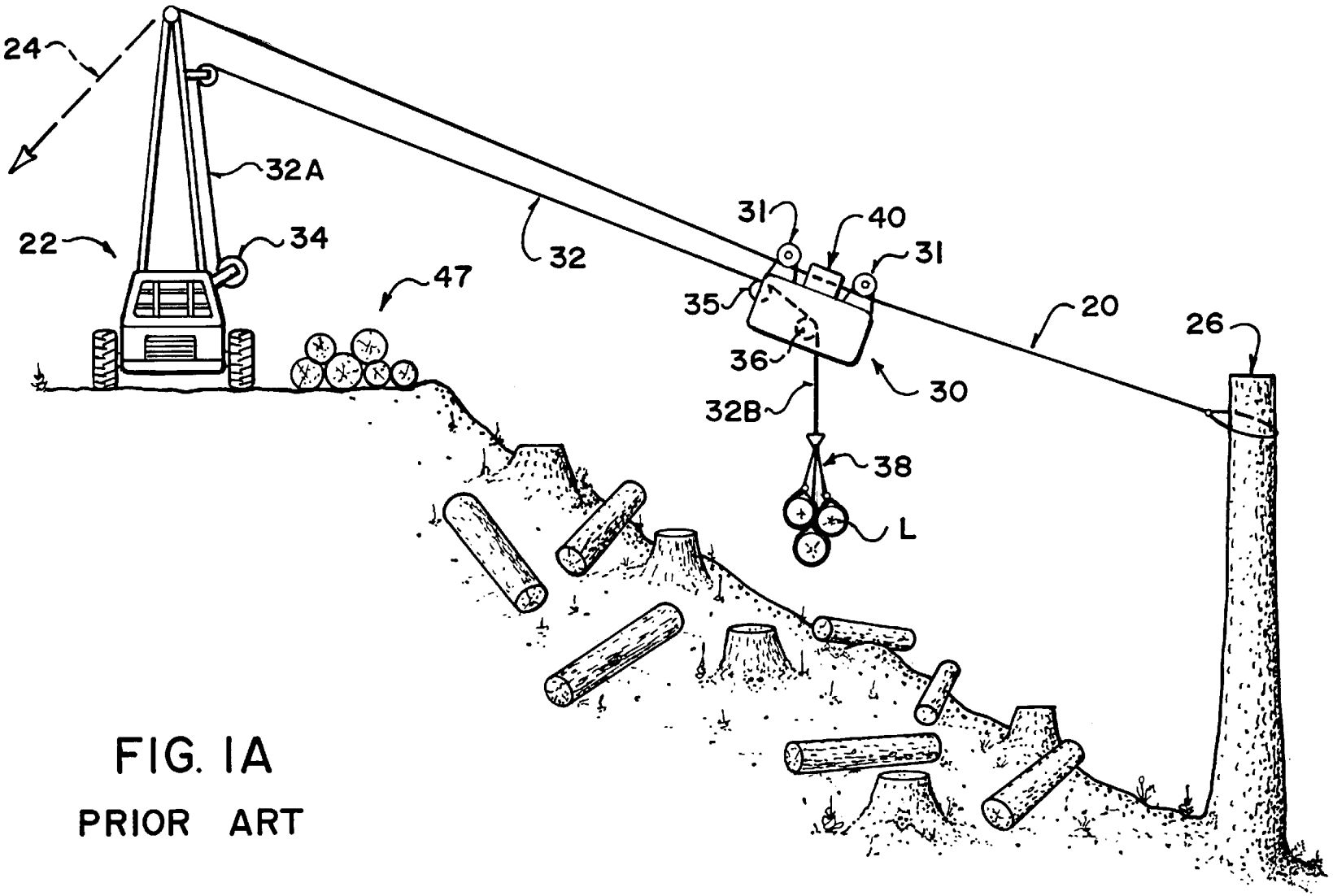
FIG. 1A PRIOR ART
FIG. 1A is a schematic view of typical apparatus used in a uphill skyline logging operation as is known in the prior art.

FIG. 1A shows a typical uphill skyline logging operation. A skyline 20 is stretched between a yarder 22 and an anchor, such as a spar tree 26. Yarder 22 may, for example, be a model C-40 16000 series yarder available from Skylead Logging Equip. Corp. of Enderby, British Columbia, Canada. One or more guy lines 24 are typically provided to stabilize yarder 22. A carriage 30 is suspended from skyline 20 by one or more sheaves 31 which can rotate as carriage 30 is moved along the skyline. A mainline (or "drag" line, or "skidding" line) 32 extends from a first end 32A which is connected to a winch 34 on yarder 22, into carriage 30 between sheaves 35 and 35A. Mainline 32 exits carriage 30 by passing over a sheave 36 in carriage 30. A second sheave 36A is typically provided where mainline 32 exits carriage 30. Mainline 32 terminates at a second end 32B which is connected to one or more chokers 38 which may each be attached to one or more logs L.

As shown in FIG. 1A, carriage 30 comprises a skyline brake 40 which, when activated, prevents movement of carriage 30 along skyline 20 and a mainline brake 42 (FIG. 1C) which, when actuated, prevents mainline 32 from pulling through carriage 30. Typically one of skyline brake 40 and mainline brake 42 is always actuated. A radio controller 44 allows an operator to switch skyline brake 40 off while actuating mainline brake 42 and vice versa by remote radio control.

In uphill operation (FIG. 1A), carriage 30 is first lowered along skyline 20 to a position which is above one or more logs L to be transported. This is done by releasing skyline brake 40 and paying out mainline 32. When carriage 30 is in the desired position then skyline brake 40 is actuated, mainline brake 42 is switched off and more of mainline 32 is payed out from winch 34. It is desired to lower chokers 38 to the ground so that a chokerman can attach them to logs to be lifted. Mainline 32 is typically heavy. The portion of mainline 32 between carriage 30 and yarder 22 tends to sag due to the weight of mainline 32. A slack puller 46 (FIG. 1C) is provided in carriage 30 to pull mainline 32 through carriage 30 and feed enough mainline 32 to a chokerman to enable the chokerman to attach chokers 38 to the logs L to be hauled. Slack puller 46 saves the chokerman from having to pull mainline 32 to logs L. The chokerman can operate slack puller 46 by remote radio control via radio controller 44.

After logs L have been attached to chokers 38 then logs L are lifted by reeling mainline 32 in at winch 34. When logs L have been lifted high enough then mainline brake 42 is actuated and skyline brake 40 is switched off. Continued reeling in of mainline 32 at winch 34 pulls carriage up along skyline 20 until it is above a landing area 47 adjacent yarder 22. Logs L may then be deposited in landing area 47.

Figure 1B:
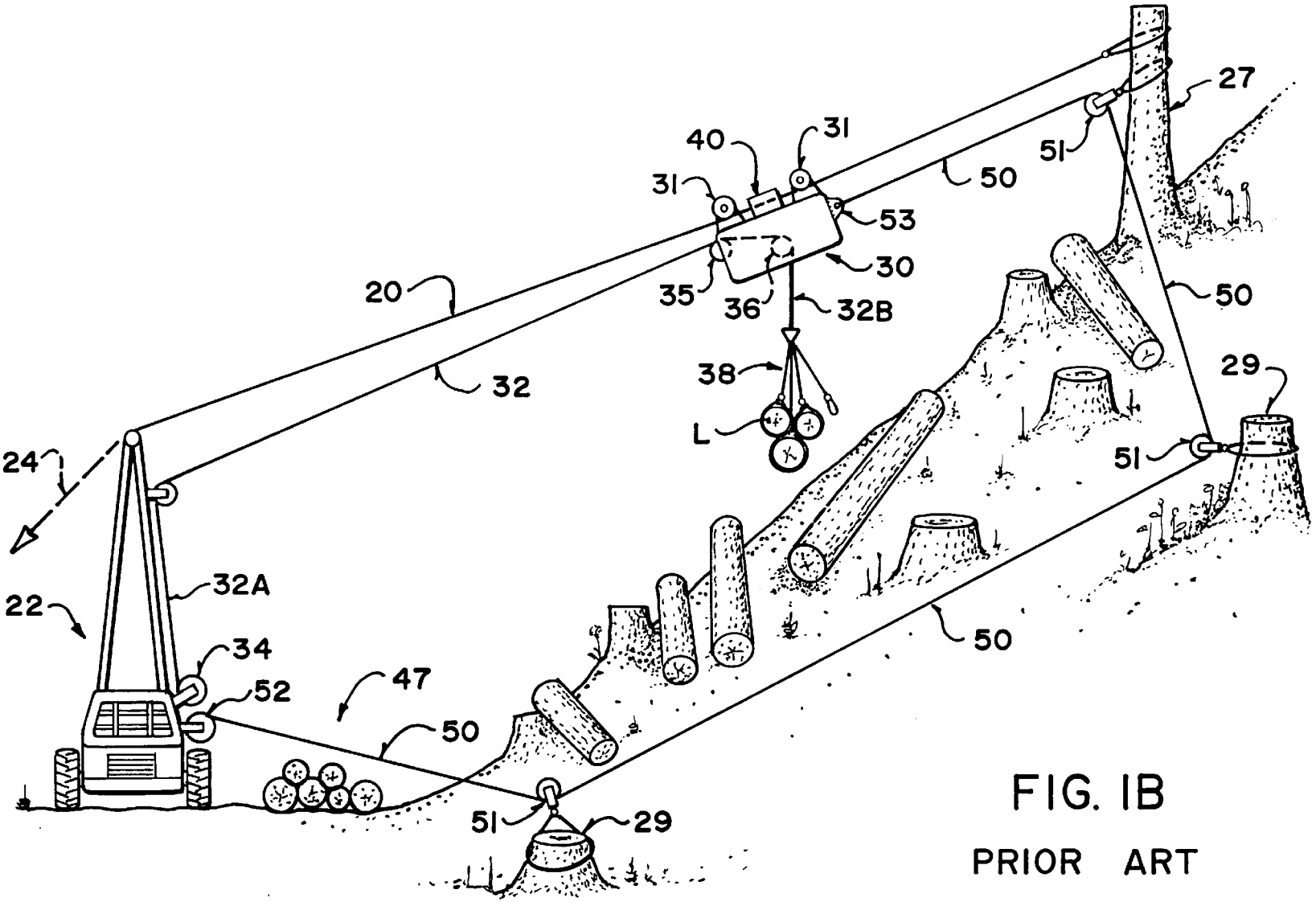
FIG. 1B PRIOR ART
FIG. 1B is a schematic view of typical apparatus used in an downhill skyline logging operation as is known in the prior art.
Figure 1C:
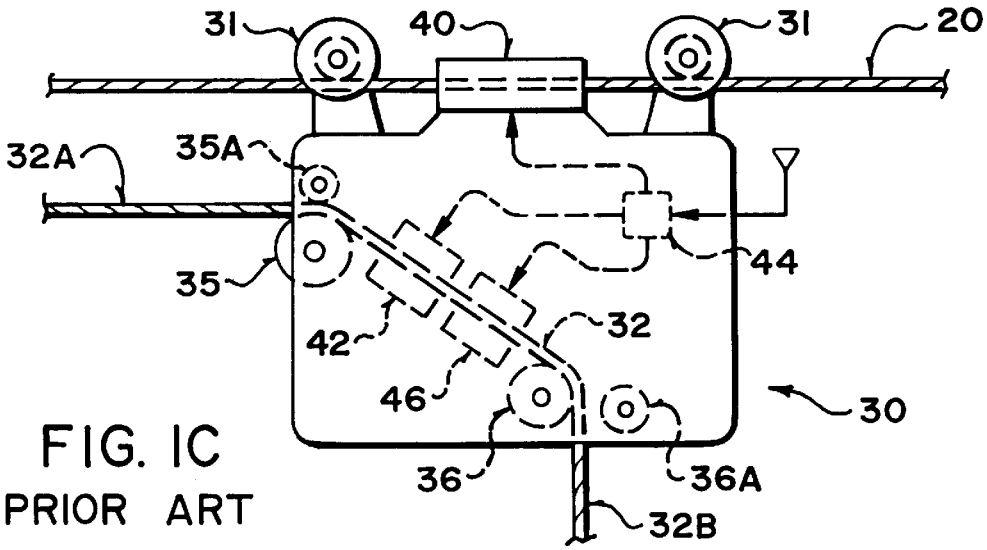
FIG. 1C PRIOR ART
FIG. 1C is a schematic view of a prior art carriage as is used in the skyline logging operations exemplified in FIGS. 1A and 1B.

FIG. 1B shows a downhill logging operation. An downhill logging operation is similar to an uphill logging operation with the exception that yarder 22 and landing area 47 are located downhill from the locations of logs L. A haulback cable 50 is provided to pull carriage 30 upwardly along skyline 20. Haulback cable 50 is connected to a winch 52 in yarder 22 and extends around a sheave 51 on spar tree 27. Other sheaves 51 attached to suitable anchors 29 may be used to keep the portion of cable 50 which lies between winch 52 and spar tree 27 clear of carriage 30. In downhill logging great demands are placed on slack puller 46 because slack puller 46 must pull mainline 32 uphill.

It is important that steps in the operation of a logging operation be completed as quickly as possible. A logging operation will not be profitable if any step in the operation is unduly slow or expensive. Loggers can tend to omit or rush steps at the expense of safety. Improving the speed and efficiency of any step in a logging operation can therefore have the effect of increasing overall safety because the time saved in completing that step can reduce the temptation to make shortcuts on other steps.

One weak link in the logging system described above is that currently available slack pullers are either unduly slow, do not have sufficient power to pull mainline 32 or cause unnecessary damage to mainline 32 (which both causes delays when mainline 32 must be repaired and is expensive). Some prior art slack pullers are slow, underpowered and cause damage to mainline 32.

This Invention

Figure 2:
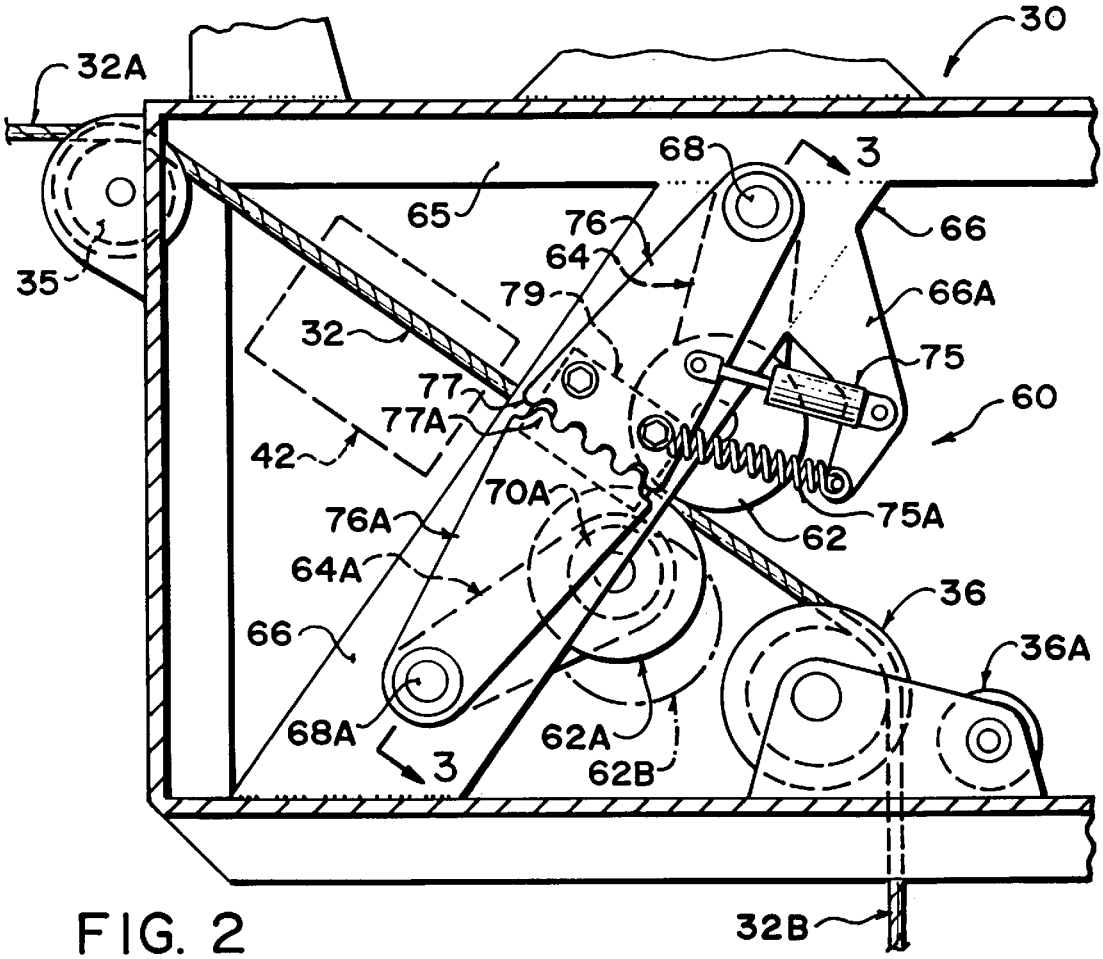
FIG. 2 is an elevational, partially schematic, view of a logging carriage incorporating a slack puller according to the invention in an engaged configuration.

This invention provides a slack puller. A slack puller 60 according to a preferred embodiment of the invention is shown in FIG. 2. Slack puller 60 may be used in place of a prior art slack puller 46 in a logging carriage 30. Slack puller 60 may also be used in other applications where it is desired to take up slack in a line 32. Line 32 may be a heavy cable, wire rope, fiber rope or the like. In a logging operation, line 32 is typically a swaged cable with a wire rope core.

Figure 5:
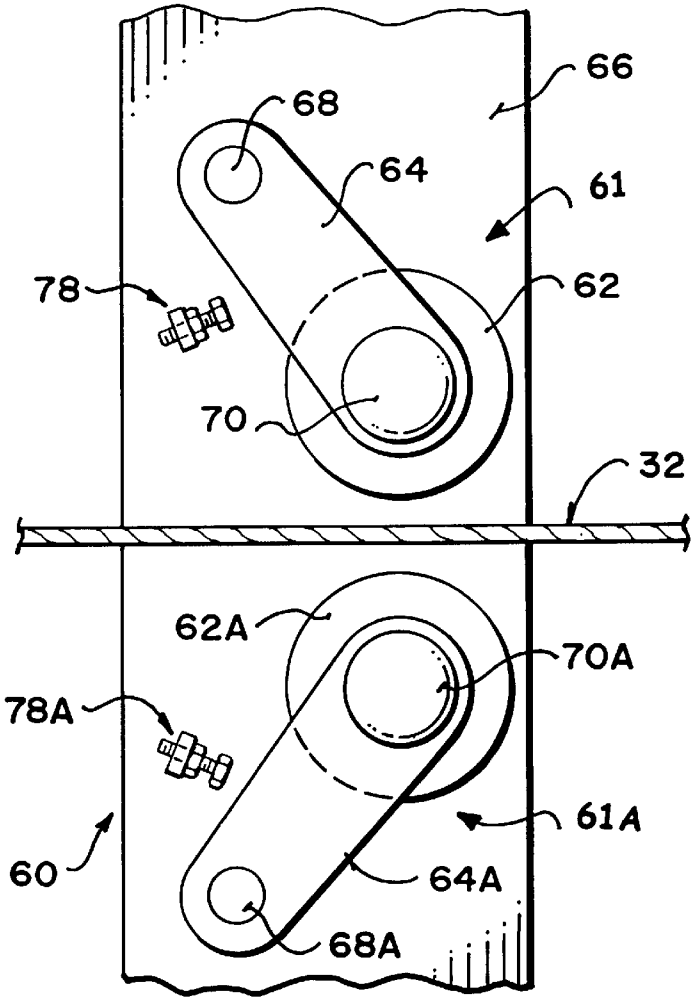
FIG. 5 is a front elevational view of the slack puller of FIG. 4 in a disengaged configuration.
Figure 4:
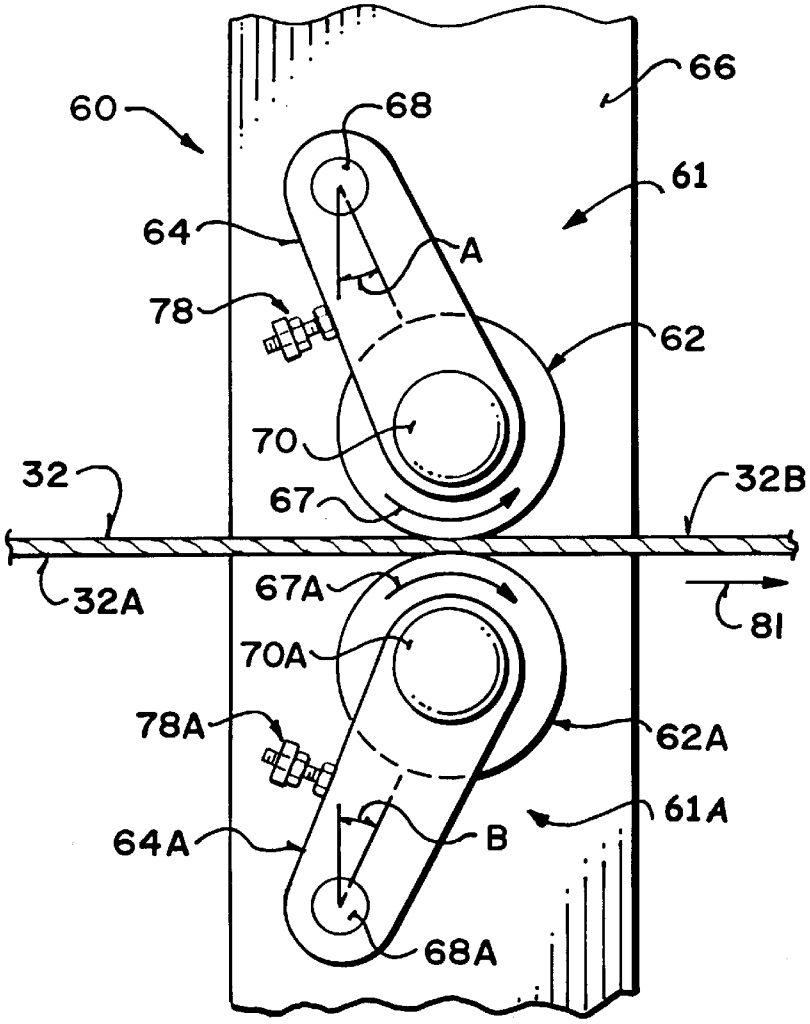
FIG. 4 is a front elevational view of a slack puller suitable for use as the slack puller portion of the carriage of FIG. 2 in an engaged configuration, the slack puller of FIG. 4 is a mirror image of the slack puller of FIGS. 2 and 3.

Slack puller 60 grips line 32 between a first sheave assembly 61 and a second sheave assembly 61A (see FIGS. 4 and 5). First sheave assembly 61 comprises a first sheave 62 mounted for rotation at one end of an arm 64. Arm 64 is pivotally mounted to a frame 66 by a pivot pin 68 which passes through a suitable bearing or bushing 69. Arm 64 and pivot pin 68 may be called a first sheave linkage that allows first sheave 62 to move in an arcuate first path relative to frame 66. Frame 66 may comprise, for example, a cross member connected to a main frame 65 of a carriage 30 (FIG. 2). Sheave 62 may be driven in rotation about its axis of rotation in the sense indicated by arrow 67 (FIG. 4) by a motor 70.

Second sheave assembly 61A is located adjacent first sheave assembly 61. Second sheave assembly 61A is preferably essentially a mirror image of first sheave assembly 61. Second sheave assembly 61A comprises a second sheave 62A mounted for rotation at one end of a second arm 64A. Second sheave 62A is preferably the same diameter as first sheave 62. Second arm 64A is pivotally coupled to frame 66 at pivot pin 68A which passes through a suitable bushing or bearing 69A. Second sheave 62A may be driven in rotation about its axis of rotation in the sense indicated by arrow 67A (FIG. 6) by a second motor 70A. Arm 64A and pivot pin 68A may be called a second sheave linkage that allows second sheave 64A to move in an arcuate second path relative to frame 66.

Arms 64 and 64A are connected by a linkage 72 (FIG. 3) which causes them to move toward each other or apart from one another in unison. Linkage 72 may be called a "coupling linkage" because it coordinates the motions of arms 64 and 64A. Linkage 72 allows arms 64 and 64A to move between a first, "engaged", configuration (shown in FIG. 4) in which sheaves 62 and 62A bear against diametrically opposed surface portions of line 32 and a second, "disengaged", position (shown in FIG. 5) in which sheaves 62 and 62A are separated so that line 32 is free to slide longitudinally between sheaves 62 and 62A. The disengaged position of sheave 62A is illustrated in dashed outline and identified by reference numeral 62B in FIG. 2.

As shown in FIG. 2, an actuator 75 which may be a hydraulic cylinder, an electrically operated actuator, or the like is provided to move arms 64 and 64A between the engaged and disengaged configurations. Actuator 75 extends between linkage 72 and a suitable anchoring member 66A. Extending actuator 75 moves arms 64 and 64A simultaneously toward their engaged configurations. Retracting actuator 75 moves arms 64 and 64A simultaneously toward their disengaged configurations. If actuator 75 is single acting then a return spring 75A is provided to return arms 64 and 64A to their disengaged configurations.

Sheaves 62 and 62A are preferably each at least 15 times the diameter of line 32 and have circumferential grooves to accept line 32. The circumferential grooves preferably have a smoothly curved profile which is somewhat deeper and narrower than semi-circular. Most preferably, the circumferential grooves have the profile known in the industry as a "fingernail" profile.

Linkage 72 maintains the angles A and B (shown in FIG. 4) generally equal to each other. A and B are the angles defined between a line connecting the pivot axes of pins 68 and 68A and lines extending between the axis of rotation of sheave 62 or 62A and the axis of rotation of the respective one of pins 68 and 68A.

Linkage 72 may comprise a pair of sector plates or "sectors" 76 and 76A (best seen in FIGS. 2 and 3) which are respectively rigidly coupled to pins 68 and 68A. Sector 76 has teeth 77 which intermesh with teeth 77A on sector 76A. Intermeshing teeth 77 and 77A cause pins 68 and 68A to counter rotate. Preferably plates 79 are provided on either side of teeth 77 or 77A on one of sectors 76 or 76A so that teeth 77 and 77A cannot jump out of engagement with one another.

Sheaves 62 and 62A counter-rotate. When arms 64 and 64A are in their engaged configuration and sheaves 62 and 62A are rotated in the directions of arrows 67 and 67A (FIG. 6) then line 32 is pulled between sheaves 62 and 62A in the direction of arrow 81. The sense of driven rotation of each of sheaves 62 and 62A is such that arms 64 and 64A are drawn farther into their engaged configuration if there is any tension in line 32.

As sheaves 62 and 62A move farther into their engaged configuration then the space between them becomes smaller. Therefore, the more resistance line 32 offers to being pulled between sheaves 62 and 62A, the more tightly sheaves 62 and 62A grip line 32. Stops 78 and 78A (best seen in FIG. 4) are provided to prevent sheaves 62 and 62A from compressing line 32 excessively. Stops 78 and 78A are preferably adjustable. As an alternative to stops 78 and 78A which act on arms 64 and 64A, actuator 75 may be equipped with stops (not shown) which limit its range of motion.

Slack puller 60 is self-actuating in the sense that increased tension on mainline 32 tends to urge arms 64 and 64A into a configuration in which mainline 32 is gripped more tightly between sheaves 62 and 62A. The self-actuating nature of slack puller 60 permits actuator 75 to be relatively small. Actuator 75 does not need to be powerful enough to apply maximum clamping forces to line 32. Actuator 75 needs only to be powerful enough to bring sheaves 62 and 62A into tight enough contact with line 32 for there to be enough friction between sheaves 62 and 62A and line 32 that the tension in line 32 will pull sheaves 62 and 62A into tighter contact with line 32. This leads to the advantage that line 32 only experiences large clamping forces when line 32 is under significant tension (when such large clamping forces are required to prevent sheaves 62 and 62A from slipping or "chattering" on line 32). At other times when the tension in line 32 is less, line 32 experiences reduced clamping forces. This tends to minimize damage to line 32.

Figure 6:
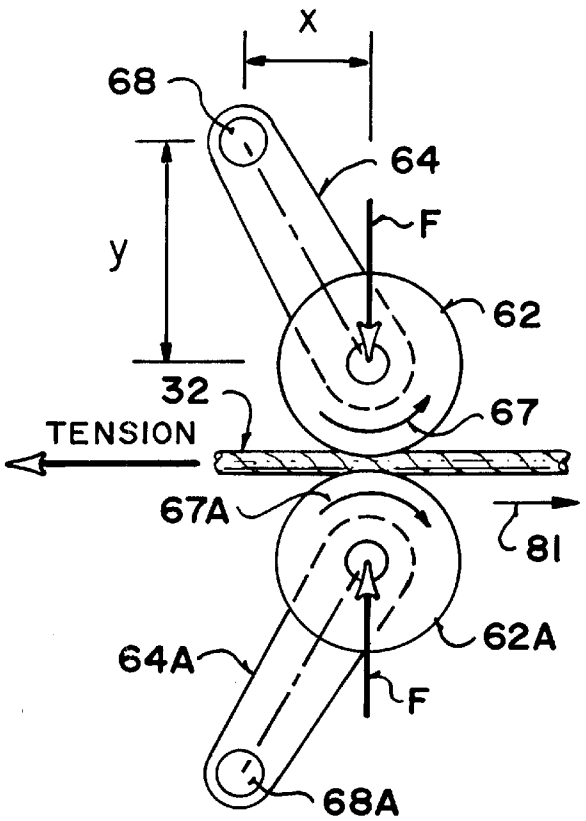
FIG. 6 is a vector diagram illustrating the forces acting on the driving sheaves in a slack puller according to the invention.

The forces acting on assemblies 61 and 61A are summarized in FIG. 6. It can be seen that the clamping force on line 32 is given by the formula:

$$F = kA + \frac{Y \times T}{2X} \quad (1)$$

Where: F is the clamping force exerted between sheaves 62 and 62A on line 32, k is a coefficient dependent upon the geometry of the linkage connecting actuator 75 to assemblies 61 and 61A, A is the force provided by actuator 75, Y is the "vertical" distance between the center of each pivot pin 68, 68A and the point of contact between the corresponding one of sheave 62, 62A and line 32; T is the tension in line 32 against which slack puller 60 is acting; and X is the "horizontal" distance between the center of each of pivot pins 68 and 68A and the axis of rotation of the corresponding sheave 62 or 62A. This assumes that sheaves 62 and 62A grip line 32 without slipping and that forces are transmitted between the various components of slack puller 60 with perfect efficiency.

It can be seen that, within reason, decreasing X leads to increased clamping force on line 32. The inventors have determined that slack puller 60 can be made to operate effectively when the angles A and B are both an angle in the range of about 10 degrees to about 40 degrees when arms 64 and 64A are in their engaged configuration. Most preferably, A and B are both an angle in the range of about 22 degrees to about 27 degrees.

Figure 3:
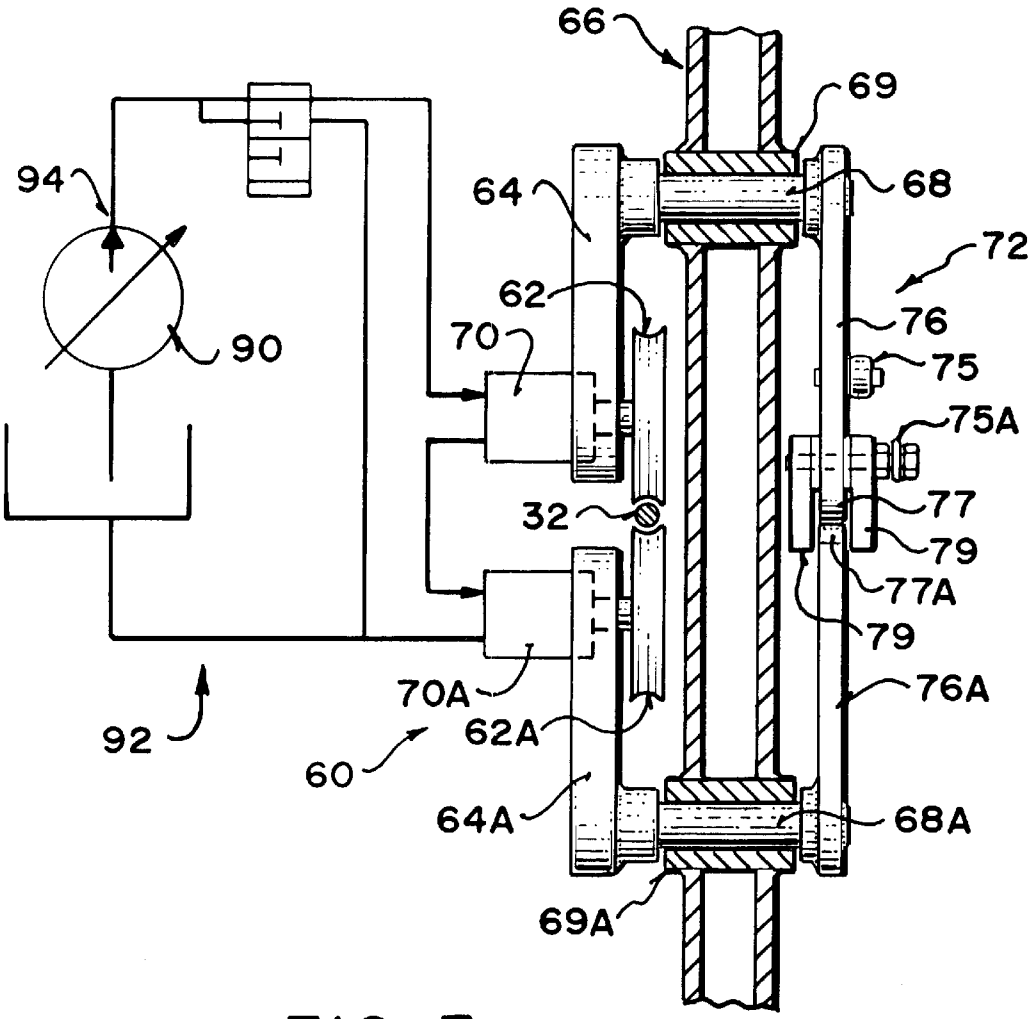
FIG. 3 is a section through a slack puller according to the invention on the line 3—3 of FIG. 2.

Motors 70 and 70A are preferably identical hydraulic motors. Most preferably motors 70 and 70A are positive displacement motors driven by the hydraulic circuit 92 of FIG. 3. As shown in FIG. 3, motors 70 and 70A are series connected. This guarantees the same flow rate through each of the motors. As the motors are identical positive displacement motors both motors will turn their respective sheaves 62, 62A at the same rate. As sheaves 62 and 62A have the same diameters then they will each pull line 32 at the same rate.

Motors 70 and 70A are driven by a pump 90. Pump 90 is driven by a suitable power source which, in a slack puller for use in a logging carriage, might be a small diesel engine mounted in the carriage. Pump 90 is preferably a pump of the type in which the volume of fluid pumped by the pump tapers off to nothing as the pressure at the pump output increases to a maximum pressure.

It can be appreciated that in hydraulic circuit 92 of FIG. 3, the pressure at the output of pump 90 will be low when there is little or no load on motors 70 and 70A and the pressure at the output 94 of pump 90 will increase as the load on motors 70 and 70A increases. Therefore, when the load on motors 70 is low (as occurs when there is little tension in line 32) the flow rate through motors 70 and 70A is high and the motors turn sheaves 62 and 62A quickly. When the load on motors 70 is high (as occurs when almost all of the slack in line 32 has been taken up—and there is therefore significant tension in line 32) the flow rate through motors 70 and 70A is low and the motors turn sheaves 62 and 62A slowly. This hydraulic circuit therefore enables slack puller 60 to quickly take up the slack in line 32 and yet, when most of the slack in line 32 has been taken up, the tension in line 32 is large, and sheaves 62 and 62A are therefore most likely to slip on line 32, sheaves 62 and 62A turn slowly so that the potential damage to line 32 from slippage of sheaves 62 and 62A against the surfaces of line 32 is reduced.

As will be apparent to those skilled in the art in the light of the foregoing disclosure, many alterations and modifications are possible in the practice of this invention without departing from the spirit or scope thereof. The following are merely examples of such modifications and alterations and are not meant to be exhaustive.

Figure 7:
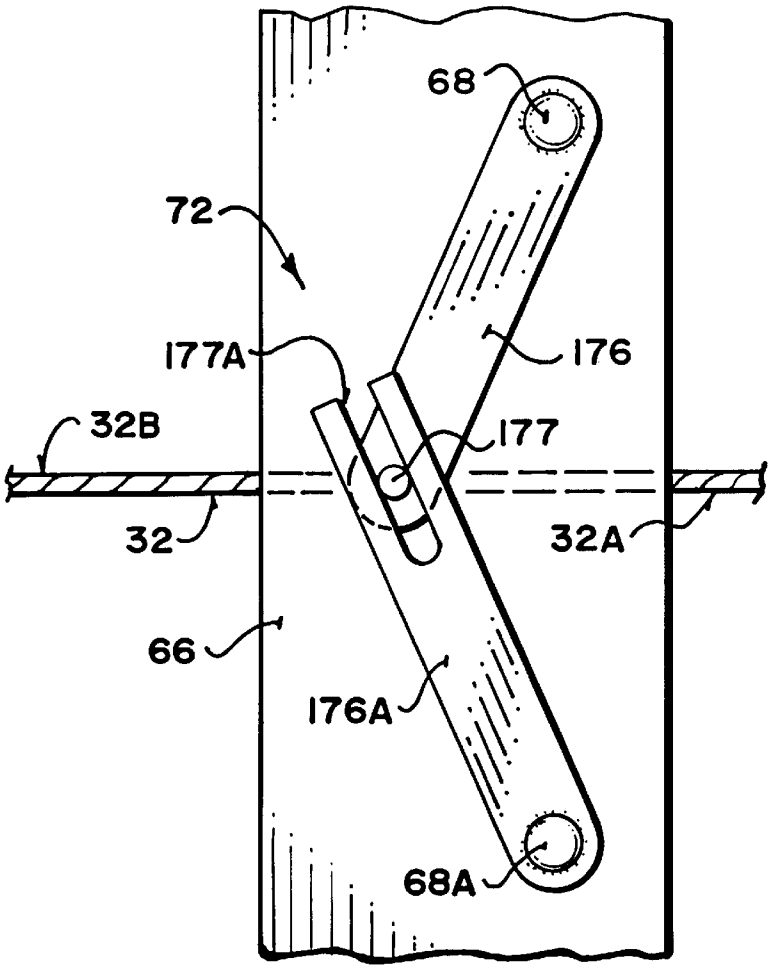
FIG. 7 is a diagram illustrating one possible alternative linkage for coordinating the motions of two arms in a slack puller according to the invention; and, FIG. 8 is a schematic view of an alternative embodiment of the invention having a single movable sheave.

Linkage 72 has been described as comprising a pair of meshing sectors. Other mechanical linkages that connect arms 64 and 64A so that their motions are coordinated as described above could also be used. For example, FIG. 7 shows an alternative linkage 72 in which sectors 76 and 76A have been replaced with arms 176 and 176A. A pin 177 on arm 176 engages a longitudinal slot 177A in arm 176A. Of course, slot 177A could be replaced with another longitudinally extending guide for pin 177 which extends longitudinally on arm 176A. In the further alternative, although it is not preferred, arms 64 and 64A could be positioned by separate actuators (not shown) controlled to coordinate the motions of arms 64 and 64A as described above.

Sheaves 62 and 62A have been described as being driven by separate motors 70 and 70A. Both sheaves could be driven by a single motor if linked together by, for example, gears or a chain drive, to counter rotate with the same surface speed. While it is not preferred, the invention could be practised in embodiments in which only one of the sheaves 62 and 62A is driven.

While the preferred embodiment of the invention uses a variable displacement pump 90 and fixed displacement motors 70 and 70A, pump 90 could be a fixed displacement hydraulic pump driven by a suitable motor. Some of the benefits of a variable displacement pump could be obtained by driving a fixed displacement pump 90 with a mechanical automatic variable ratio transmission so that the speed at which pump 90 is driven is reduced as the load on pump 90 increases. Suitable small automatic variable ratio transmissions are commonly available and are used to drive snowmobiles and the like.

In the further alternative, sheaves 62 and 62A could be driven directly by an engine through a suitable mechanical transmission. Once again, some of the benefits of the preferred embodiment could be obtained by using an automatic variable ratio transmission to drive sheaves 62 and 62A.

Figure 8:
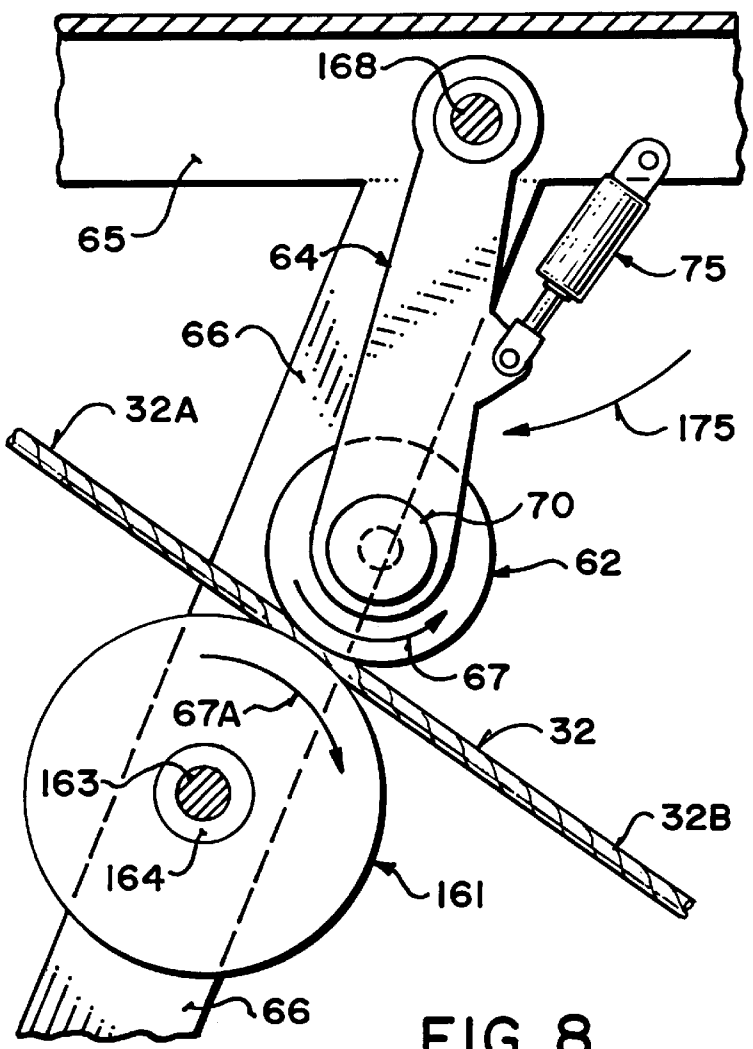

Slack puller 60 is shown as comprising a pair of mirror image sheave assemblies 61 and 61A. While not preferred, some of the advantages of the invention could be obtained by replacing one of sheave assemblies 61 and 61A with a sheave 161 which has a fixed axis of rotation as shown in FIG. 8. Sheave 161 is pivotally mounted to a post 163 by a bearing 164. In the embodiment of FIG. 8 a sheave 62 is mounted on an arm 64 which is movable about a pivot member 168 by means of an actuator 75. Arm 64 may be moved in direction 175 to engage sheave 62 with mainline 32.

Post 163 of sheave 161 could be fixed in relation to pivot member 168. Sheave 62, or both sheaves 62 and 161 may be driven in the directions indicated by arrows 67 and 67A respectively. It can be appreciated that, when mainline 32 is under tension, the driven rotation of sheave 62 tends to pull arm 64 in the direction of arrow 175 thereby increasing the force with which mainline 32 is gripped between sheaves 62 and 161.

From all of the foregoing one can appreciate that, in its most basic form, the invention provides a slack puller for pulling on a cable. The slack puller includes a first sheave assembly. The first sheave assembly includes a first sheave which is rotatable about an axis of rotation and is movably coupled to a frame by a first sheave linkage of some kind. The first sheave linkage is not necessarily a pivotally mounted arm as described above (although this is preferred), but may be any linkage which permits the first sheave to be moved along a path, oriented as described below, from a first end to a second end.

A second rotatable sheave is mounted to the frame adjacent the first sheave. The second sheave is spaced apart from the first sheave sufficiently to receive a cable between the first and second sheaves. The path is oriented so that, as the first sheave is moved along the path from the first end of the path to the second end of the path, it approaches the second sheave and also moves along the cable. The first sheave does not approach the cable perpendicularly as do sheaves in some prior art slack pullers.

The cable is capable of freely sliding between the first and second sheaves when the first sheave is at the first end of the first path. The cable becomes gripped between the first and second sheaves as the first sheave is moved along the path toward the second sheave by an actuator. A drive is provided for turning the first sheave in a first sense. The first sense is such that tension in the cable tends to draw the first sheave toward the second end of the first path, thereby compressing the cable more tightly between the first and second sheaves. The more tension there is in the cable, the more tightly the cable is gripped.

Other alterations and modifications are possible in the practice of this invention without departing from the spirit or scope thereof. Accordingly, the scope of the invention is to be construed in accordance with the substance defined by the following claims.

What is claimed is:

1. A slack puller for taking up slack in a line, the slack puller comprising:

a) a first sheave rotatable about a first sheave axis of rotation, the first sheave movably coupled to a frame by a first sheave linkage such that the first sheave axis of rotation is movable in a first arcuate path between first and second positions of the first sheave;

b) a second sheave coupled to the frame and rotatable about a second sheave axis of rotation;

c) an actuator coupled between the frame and the first sheave to move the first sheave between its first and second positions; and, d) a motor for turning the first sheave about the first sheave axis of rotation;

wherein: when the first sheave is in its first position, a line extending between the first and second sheaves is compressed between the first and second sheaves; when the first sheave is in its first position and the motor is operated to turn the first sheave about the first sheave axis of rotation, the line is pulled between the first and second sheaves, and tension in the line together with friction between the line and the first sheave tend to pull the first sheave along the arcuate path in a direction which moves the first sheave axis of rotation closer to the second sheave axis of rotation; and, when the first sheave is in its second position, the line is free to slip longitudinally between the first and second sheaves.

2. The slack puller of claim 1 wherein the first sheave linkage comprises an arm pivotally mounted to the frame.

3. The slack puller of claim 1 wherein the second sheave is coupled to the frame by a second sheave linkage such that the second sheave axis of rotation is constrained to travel in a second arcuate path between first and second positions and the slack puller comprises a coupling linkage coupling the first and second sheave linkages, the coupling linkage moving the second sheave from its first position to its second position in response to motion of the first sheave from its first position to its second position.

4. The slack puller of claim 3 wherein the first and second sheave linkages respectively comprise first and second arms pivotally coupled to the frame and the first and second sheaves are respectively rotatably mounted on the first and second arms.

5. The slack puller of claim 4 wherein the first and second sheaves are equal in diameter.

6. The slack puller of claim 5 wherein the first and second sheaves are respectively turned by first and second motors respectively mounted on the first and second arms.

7. The slack puller of claim 6 wherein the first and second motors are positive displacement hydraulic motors connected in series with a hydraulic pump.

8. The slack puller of claim 7 wherein the hydraulic pump is of the type where a rate of flow of fluid output by the pump approaches zero as an output pressure approaches a maximum pressure.

9. The slack puller of claim 3 wherein the coupling linkage comprises first and second sectors bearing intermeshing teeth, the first and second sectors rigidly coupled to the first and second sheave linkages.

10. The slack puller of claim 3 wherein the coupling linkage comprises a first member rigidly coupled to the first sheave linkage, a second member rigidly coupled to the second sheave linkage, and a pin on the first member slidably engaged with a longitudinally extending groove in the second member.

11. A slack puller for pulling a cable, the slack puller comprising:

a) first and second sheave assemblies mounted to a frame on either side of a cable path, each of the sheave assemblies comprising an arm pivotally mounted to the frame at a pivot point, a sheave mounted to the arm for rotation about an axis of rotation, and a motor for turning the sheave about its axis of rotation, the sheaves both located on the same side of a reference line joining the pivot points of the first and second sheave assemblies;

b) a linkage connected between the first and second sheave assemblies, the linkage coupling the arms of the first and second sheave assemblies to move toward one another or away from one another;

c) an actuator coupled to the first sheave assembly for moving the arms between an engaged configuration in which the sheaves would bear against opposed sides of a cable extending along the cable path and a disengaged position wherein the sheaves would not contact a cable extending along the cable path;

wherein, when the arms are in the engaged configuration, a line between the axis of rotation and the pivot point defines an angle with the reference line in the range of about 10 degrees to about 40 degrees.

12. The slack puller of claim 11 wherein the sheaves of the first and second sheave assemblies are equal in diameter.

13. The slack puller of claim 12 wherein the motors of the first and second sheave assemblies are each positive displacement hydraulic motors and are connected in series with a hydraulic pump.

14. The slack puller of claim 13 wherein the hydraulic pump is of the type where a rate of flow of fluid output by the pump approaches zero as an output pressure approaches a maximum pressure.

15. The slack puller of claim 11 wherein the linkage comprises first and second sectors bearing intermeshing teeth, the first and second sectors respectively rigidly coupled to the first and second sheave assemblies.

16. The slack puller of claim 11 wherein the linkage comprises a first member rigidly coupled to the first sheave assembly a second member rigidly coupled to the second sheave assembly and a pin on the first member slidably engaged with a longitudinally extending groove in the second member.

17. A slack puller comprising:

a) a first sheave rotatably mounted on an arm;

b) means for moving the arm to bring the first sheave into contact with a cable thereby compressing the cable against a second sheave; and, c) driving means for rotating the first sheave in a first sense;

wherein, when the first sheave is compressing the cable against the second sheave and is being rotated in the first sense by the driving means, tension in the cable acting on the first sheave pivots the arm and thereby moves the first sheave to a position in which it compresses the cable more tightly against the second sheave.

18. A slack puller for pulling on a cable, the slack puller comprising:

a) a first sheave assembly comprising a first rotatable sheave having a first sheave axis of rotation and movably coupled to a frame by a first sheave linkage, the first sheave linkage permitting the first sheave to be moved along a first path from a first end to a second end, the first path extending in a plane perpendicular to the first sheave axis of rotation;

b) a second sheave assembly comprising a second rotatable sheave having a second sheave axis of rotation and movably coupled to the frame by a second sheave linkage, the second sheave linkage permitting the second sheave to be moved along a second path from a first end to a second end, the second path extending in a plane perpendicular to the second sheave axis of rotation, the second sheave spaced apart from the first sheave sufficiently to receive a cable between the first and second sheaves, the cable capable of sliding between the first and second sheaves when the first and second sheaves are at the first ends of the first and second paths respectively, the first and second paths converging such that the cable is gripped between the first and second sheaves when the first and second sheaves are at points intermediate the first and second ends of the first and second paths respectively;

c) one or more actuators for respectively advancing the first and second sheaves together along the first and second paths from the first ends toward the second ends; and, d) a drive for turning the first sheave in a first sense, the first sense such that tension in the cable tends to draw the first sheave toward the second end of the first path.

19. A slack puller according to claim 18 comprising a drive for turning the second sheave in a second sense, the second sense such that tension in the cable tends to draw the second sheave toward the second end of the second path.

20. A slack puller for pulling on a cable, the slack puller comprising:

a) a first sheave assembly comprising a first rotatable sheave having a first sheave axis of rotation and movably coupled to a frame by a first sheave linkage, the first sheave linkage permitting the first sheave to be moved along a first path from a first end to a second end, the first path extending in a plane perpendicular to the first sheave axis of rotation;

b) a second sheave assembly comprising a second rotatable sheave having a second sheave axis of rotation, the second sheave spaced apart from the first sheave sufficiently to receive a cable between the first and second sheaves, the cable capable of sliding between the first and second sheaves when the first sheave is at the first ends of the first path, the first path approaching the axis of rotation of the second sheave such that the cable is gripped between the first and second sheaves when the first sheave is at a point intermediate the first and second ends of the first path;

c) an actuator for advancing the first sheave along the first path from the first end toward the second end; and, d) a drive for turning the first sheave in a first sense, the first sense such that tension in the cable tends to draw the first sheave toward the second end of the first path.

* * * * *